US009080422B2

(12) United States Patent
Melenyzer

(10) Patent No.: US 9,080,422 B2
(45) Date of Patent: Jul. 14, 2015

(54) LINER WIPER PLUG WITH BYPASS OPTION

(75) Inventor: George J. Melenyzer, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 272 days.

(21) Appl. No.: 13/596,134

(22) Filed: Aug. 28, 2012

(65) Prior Publication Data

US 2013/0092375 A1 Apr. 18, 2013

Related U.S. Application Data

(60) Provisional application No. 61/530,794, filed on Sep. 2, 2011.

(51) Int. Cl.
*E21B 33/16* (2006.01)
*E21B 33/05* (2006.01)
*E21B 43/26* (2006.01)

(52) U.S. Cl.
CPC ..... *E21B 33/16* (2013.01); *E21B 33/05* (2013.01); *E21B 43/261* (2013.01)

(58) Field of Classification Search
CPC ..... E21B 23/01; E21B 33/14; E21B 33/16; E21B 33/05; E21B 43/261
USPC ..... 166/285, 208, 183, 153, 380, 382
See application file for complete search history.

(56) References Cited

U.S. PATENT DOCUMENTS

| | | | | |
|---|---|---|---|---|
| 5,722,491 | A * | 3/1998 | Sullaway et al. | 166/291 |
| 2002/0139529 | A1 | 10/2002 | Fraser | |
| 2004/0154798 | A1 * | 8/2004 | Vincent et al. | 166/291 |
| 2007/0102158 | A1 | 5/2007 | Szarka | |
| 2008/0251253 | A1 | 10/2008 | Lumbye | |
| 2010/0155065 | A1 * | 6/2010 | Misselbrook | 166/280.1 |
| 2010/0294503 | A1 | 11/2010 | Laurel | |

FOREIGN PATENT DOCUMENTS

| | | |
|---|---|---|
| EP | 1012442 | 12/2005 |

* cited by examiner

*Primary Examiner* — Brad Harcourt
(74) *Attorney, Agent, or Firm* — Michael Stonebrook

(57) ABSTRACT

Methods and apparatus for liner wiper plugs with bypass options to allow displacing fluid to be pumped through after the liner wiper plug is set in a liner hanger system landing collar. By pumping displacing fluids through the bypass, uncured cement may be removed from the shoe track area and an area external to the shoe track area.

10 Claims, 4 Drawing Sheets

LINER WIPER PLUG WITH BYPASS OPTION

CROSS REFERENCE TO RELATED APPLICATION

The present document is based on and claims priority to U.S. Provisional Application Ser. No. 61/530,794, filed Sep. 2, 2011, incorporated herein by reference.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir. One piece of equipment which may be installed is a liner hanger system which may incorporate a liner wiper plug.

SUMMARY

In some embodiments, a method of cementing a liner hanger system is a wellbore includes providing a liner hanger system which has at least a float shoe, a setting tool with liner wiper plug, and a landing collar. The liner hanger system is cemented into the wellbore by pumping cement through the liner hanger system. A pump down plug may then be introduced into the system, the plug landing in the liner wiper plug to form a combined liner wiper plug assembly. The assembly may then disengage from the setting tool, travel through a portion of the liner hanger system, land on the landing collar, and create a pressure seal around the landing collar. A bypass on the liner wiper plug may then be opened, and displacement fluids pumped through the bypass to clear cement located in the shoe track area between the landing collar and the float shoe. The remaining cement around the liner hanger may then cure while leaving the shoe track area and an area outside the shoe track area, at least partly free of cement, which allows for fluid communication from within the liner hanger system to the formation surrounding the wellbore.

In some embodiments, a liner wiper plug includes first and second ends where the first end is suitable to engage or interface with a pump down plug, and the second end is suitable to engage or interface with a landing collar. A flow path is present through the liner wiper plug, which allows fluid communication from the first end to the second end. The liner wiper plug also has wiper seal elements which are suitable to form a pressure seal between the exterior of the liner wiper plug and the liner or the liner hanger system in which the liner wiper plug is deployed. A bypass mechanism may also be included on the liner wiper plug, which when activated allows for fluid communication from outside the liner wiper plug into the flow path through the liner wiper plug.

BRIEF DESCRIPTION OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of this disclosure.

DETAILED DESCRIPTION

Figure 1:
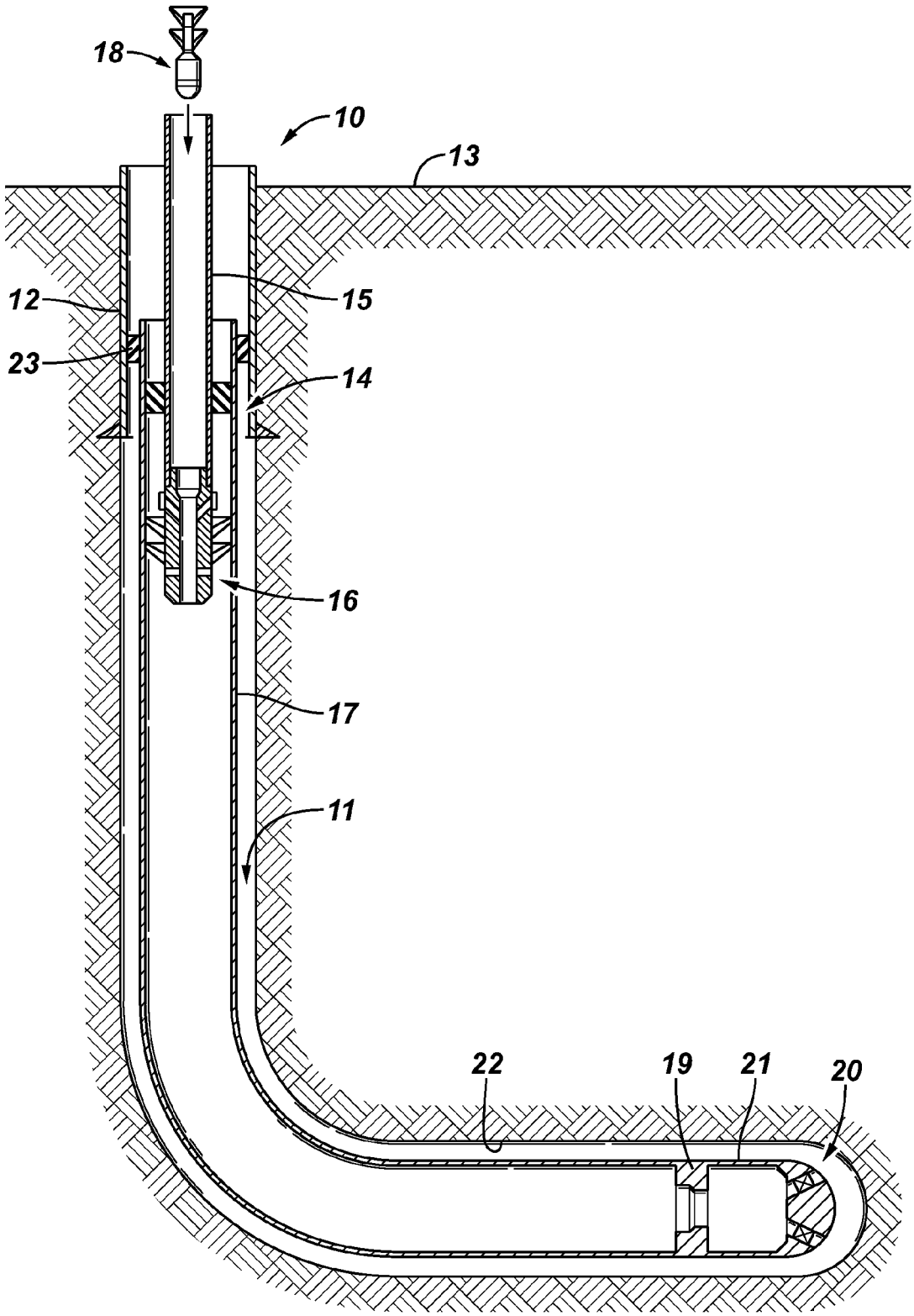
FIG. 1 is an illustration of an embodiment of a well system, according to an embodiment of the disclosure.

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

In some instances, a well system includes a liner hanger system deployed within the well. In some cases, the liner hanger system is deployed partly within a cased section of the well, and partly in an uncased, open hole section of the well. The liner hanger system may provide the containment and pressure barrier used to separate the reservoir from the production flow path to the surface. In other words, the liner hanger system may act as a well completion element that provides control for the production of hydrocarbon from a reservoir, and allows for a flow path to bring the hydrocarbon to the well surface.

For purposes of creating a well system with a liner hanger, a wellbore may be first drilled and then at least partially cased with a casing string. The casing string may be cemented into place. The liner hanger system may then be inserted into the well, and anchored in place in the cased part of the well. The anchor may include a packer or other type of anchoring device. The liner hanger system may then extend into the uncased or open hole portion of the well. One component that may be included in a liner hanger system is a float shoe, which typically is deployed at the furthest most (from surface) deployed portion of the liner. The float shoe may include check valves or poppet type valves to allow fluid to flow from the interior of the float shoe to the exterior of the float shoe, and therefore from the interior of the liner hanger system to the exterior of the liner hanger system.

Another component that may be included in a liner hanger system is a landing collar. The landing collar is typically located as part of the liner above the float shoe, and it may serve as a seat and latch for a plug which is pumped down into the liner hanger system. When a conventional plug (e.g. a liner wiper plug) is landed and latched on the landing collar, the liner hanger system may hold pressure both above and below the landing collar. The portion of the liner hanger system between the landing collar and the float shoe is generally referred to as the "shoe track".

In some instances, the liner hanger system may be cemented into the well system. Cement may be introduced from the surface, and pumped downhole through the liner hanger system. In some embodiments, the cement is pumped through a liner hanger system setting tool, which is deployed on the interior of the liner. The cement may then run the length of the liner hanger system, and exit the system through the valves in the float shoe. The exiting cement may then fill the space external to the liner hanger system, for instance, the space between the exterior of the liner hanger system and the drilled open hole or the casing.

Once a sufficient amount of cement is pumped to properly cement the liner hanger into the well system, a pump down plug may be pumped or dropped down the liner hanger setting tool with displacement fluid. The pump down plug is sized to land and engage with the liner wiper plug which is typically installed at the terminal end of the liner hanger setting tool. The pump down plug lands and engages with the liner wiper plug to form a liner plug assembly. Pressure behind the liner wiper plug assembly will cause the liner wiper plug assembly to disengage from the liner hanger system (e.g. to shear off), and travel down through the liner hanger system until it lands and engages in the landing collar.

While the liner wiper plug assembly travels through the liner hanger system, it forces any excess cement present ahead of it in the interior of the liner hanger system, and 'wipes' the inner surface of the liner hanger system free of cement. Liner wiper plug assembly may have at least one wiper seal element for this purpose. When liner wiper plug assembly lands in the landing collar, a pressure seal is formed so that pressure may be maintained on either side of the landed plug assembly. With this seal in place, additional cement will not be displaced by the pumping of displacement fluid from surface, and therefore any cement present in the shoe track will cure and form a cement plug in the shoe track. In some instances the entire shoe track may be filled with a solid cement plug, and in other instances only a portion of the shoe track may be plugged with cement.

The cement plug in the shoe track may need to be removed (e.g. by drilling) depending on what the next intended well operation is. For instance, if the next intended well operation is a fracturing operation, the cement plug in the shoe track will need to be removed to allow fracturing fluids to travel through the liner hanger system and out the end, or toe, of the well. Likewise, if the shoe track portion is in a horizontal portion of the well system it may not be possible to pump perforating guns in the horizontal portion of well, as cement plug in the shoe track would not allow displacing fluids to be used to pump the guns into the horizontal portion. In these and other instances, the cement plug in the shoe track may need to be drilled out before additional well operations may be performed. Drilling adds an additional operation and expense, and may require the deployment of surface assets to facilitate the drilling.

Referring to FIG. 1, a well system 10 is shown. A wellbore 11 that is partially lined by casing 12 extends downhole from the well surface 13. A liner hanger system 14 is also provided in the wellbore 11. Liner hanger system 14 includes several components, such as setting tool 15, liner wiper plug 16, liner 17, pump down plug 18, landing collar 19, and float shoe 20. The shoe track 21 is shown as the portion of the liner hanger system 14 located between landing collar 19 and float shoe 20. Liner hanger system 14 is also at least partially deployed in an uncased or open hole portion 22 of the wellbore 11. Anchoring member 23 anchors the liner hanger system in place in the well, by engaging with the casing 12. Anchoring member 23 may be a packer device or other type of anchoring device able to engage with the casing and to support the weight of the lower deployed liner hanger system 14 components.

It is noted that well system 10 shown in FIG. 1 is simplified for clarifying the following description. Thus, the well system 10 may have other and different features than those shown. For example, well system 10 and liner hanger system 14 in particular may include additional and various bushings, packers, valves, joints, and setting/engagement tools. Likewise, while part of wellbore 11 is shown as deviated or horizontal in FIG. 1, in other orientations the wellbore 11 may be vertical. Further, unless otherwise described the various liner hanger system components (e.g. landing collar, float shoe) may be conventional system components, as known to one of skill in the art.

Figure 2:
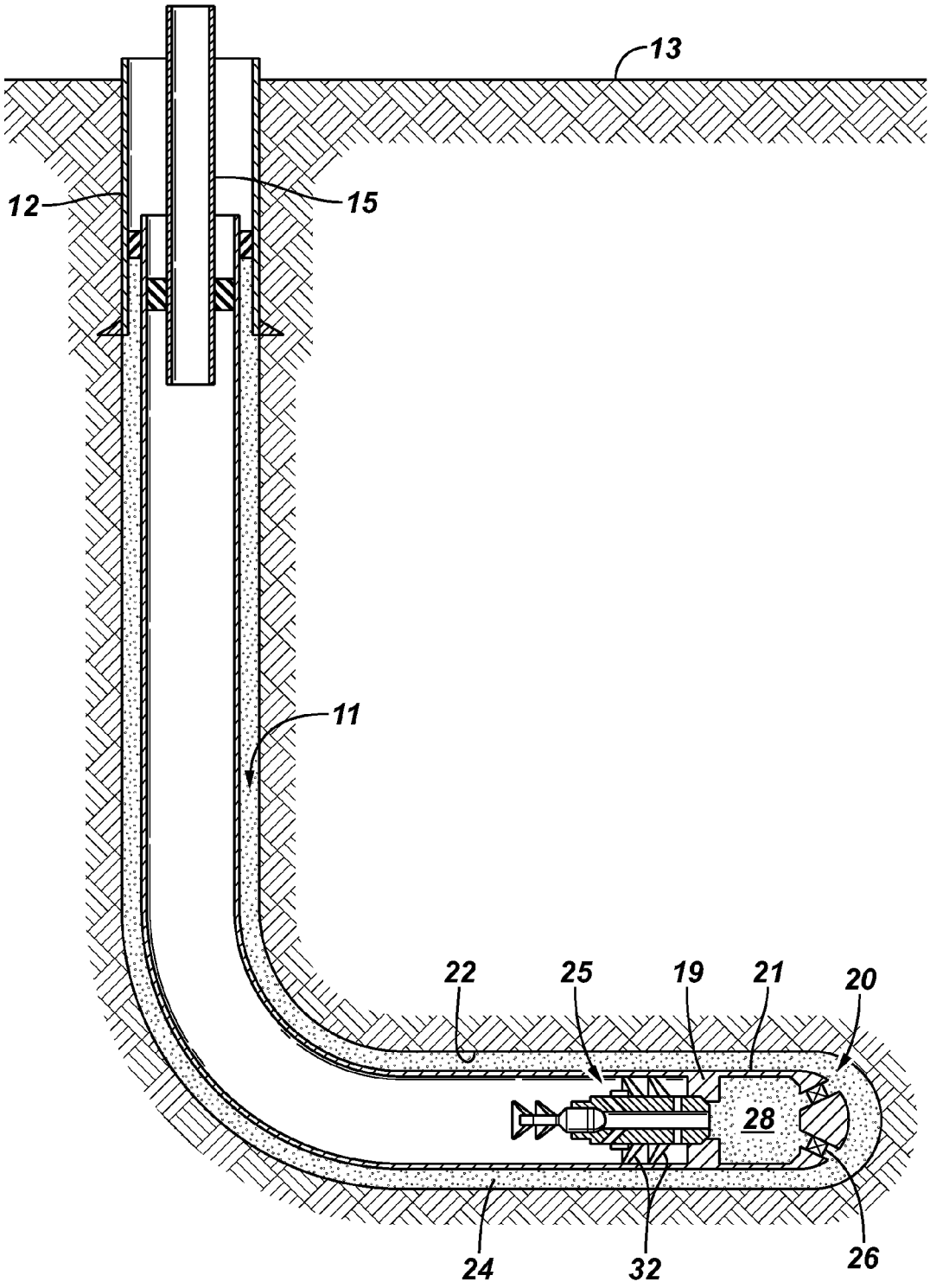
FIG. 2 is another illustration of an embodiment of an well system, according to an embodiment of the disclosure.

Referring now to FIG. 2, an embodiment of the liner hanger system 14 of FIG. 1 is shown after a cementing operation. Cement 24 may be deployed through the liner hanger setting tool 15 to cement the liner hanger system 14 into the wellbore 11. Sufficient amounts of cement 24 may be pumped through the liner hanger system 14 to fill the space between the exterior of the liner hanger system 14 and the open hole portion 22 of the wellbore 11. The space between the liner hanger system 14 and the casing 12 may also have cement deployed in-between, as shown. Cement may travel through the liner hanger system 14, through the landing collar 19 and the float shoe 20. The float shoe 20 may include valves 26, which may be one-way type check or poppet valves, and which allow the cement to travel from the interior to the exterior of the liner hanger system 14.

After the desired amount of cement is deployed into the wellbore 11, a pump down plug 18 may be dropped through the liner hanger setting tool 15, thereby allowing the pump down plug to engage with the liner wiper plug 16 to form a liner wiper plug assembly 25. Displacement fluids may also be pumped in conjunction with the pump down plug. Liner wiper plug assembly 25 creates a pressure seal within the liner hanger system 14, and the liner wiper plug assembly 25 may disengage after a predetermined pressure differential across the assembly is reached. The pressure differential may be created from the surface via the pumping of displacing fluid. Once the liner wiper plug assembly 25 disengages from the liner hanger setting tool 15, it may travel through the interior of the liner hanger system 14, displacing cement and cleaning or wiping the excess cement from the interior of the liner 17. Liner wiper plug assembly 25 may have at least one wiper seal element 32 to facilitate the wiping or cleaning of the liner 17. Liner wiper plug assembly 25 continues through the liner hanger assembly 14, until it engages with the landing collar 19. Once engaged, the liner wiper plug assembly 25 and the wiper seal element 32 form a pressure seal so that pressure may be maintained on either side of the landing plug assembly 25. With this seal in place, additional cement will not be displaced from the interior of the liner hanger system 14, and a cement plug 28 may form in the shoe track 21 area.

Figure 3A:
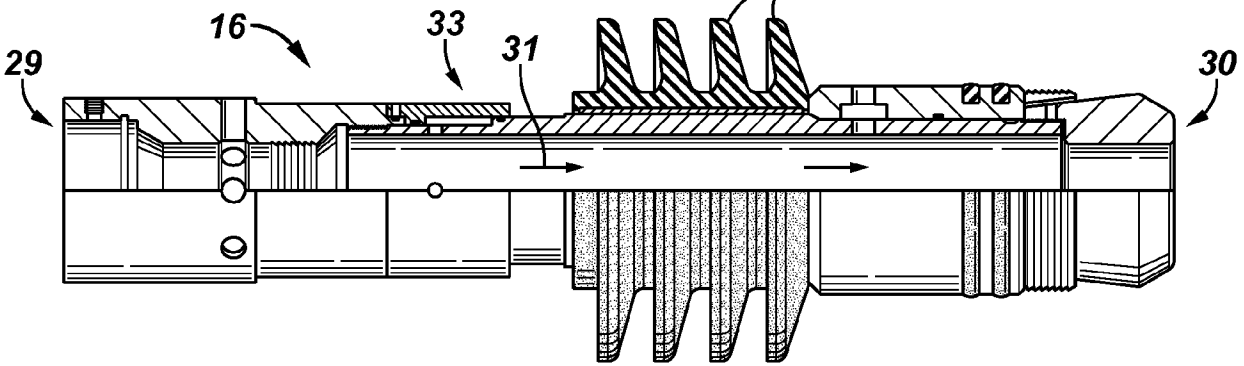
FIG. 3 is an illustration of a liner wiper plug, according to an embodiment of the disclosure.

FIG. 3A shows an embodiment of a liner wiper plug 16. Liner wiper plug 16 has a first end 29 and a second end 30. First end 29 may be suitable to engage or interface with a pump down plug 18, while second end 30 may be suitable to engage or interface with landing collar 19. A flow path 31 exists through liner wiper plug 16, whereby fluid may flow through the interior of liner wiper plug 16, from first end 29 to second end 30. When the second end 30 is engaged with landing collar 19, all flow through the liner hanger system 14 past landing collar 19 may be forced to flow through flow path 31. Flow path 31 may be interrupted when pump down plug 18 is engaged with first end 29, in that flow may not pass a properly engaged pump down plug 18.

Liner wiper plug 16 may also comprise a plurality of liner wiper seal elements 32, located on the exterior of liner wiper plug 16. Seal elements 32 may be made of metal, polymer, elastomer, or any other suitable material, and may serve to form a pressure barrier between liner wiper plug 16 and the interior of the liner 17 (or by extension, the interior of the liner hanger system 14), such that when pump down plug 18 is engaged with the first end 29 and the second end 30 is engaged with the landing collar 19, pressure will at least initially be held by the seal elements 32. Seal elements 32 may also be suitable to 'wipe' excess cement from the interior of the liner 17, as the liner wiper plug 16 travels through the liner hanger system 14, prior to engaging with the landing collar 19.

Liner wiper plug 16 may also comprise at least one bypass system 33, which is suitable to allow fluid communication from outside the liner wiper plug 16 and into the flow path 31 through the liner wiper plug 16. For instance, bypass system 33 may allow this fluid flow or communication when the liner wiper plug 16 is properly engaged or interfaced with the landing collar 19 and the pump down plug 18. Bypass system may be activated by an increase in pressure external to the liner wiper plug (but internal to the overall liner hanger system 14). In some embodiments, bypass system 33 may include a primary bypass system and a secondary bypass system such that the secondary bypass system is activated when the primary bypass system fails to activate. For instance, primary bypass system may be set to activate at a pressure lower than the activation setting for the secondary bypass system. In this configuration, proper activation of the primary bypass system would cause the pressure external to the liner wiper plug 16 to decrease, thereby not reaching the threshold necessary for the secondary bypass system to activate. Likewise, if the primary bypass system fails to open or activate, pressure external to the liner wiper plug 16 could continue to rise until the activation threshold for the secondary bypass system is reached, thereby triggering the activation of the secondary bypass system.

Figure 3B:
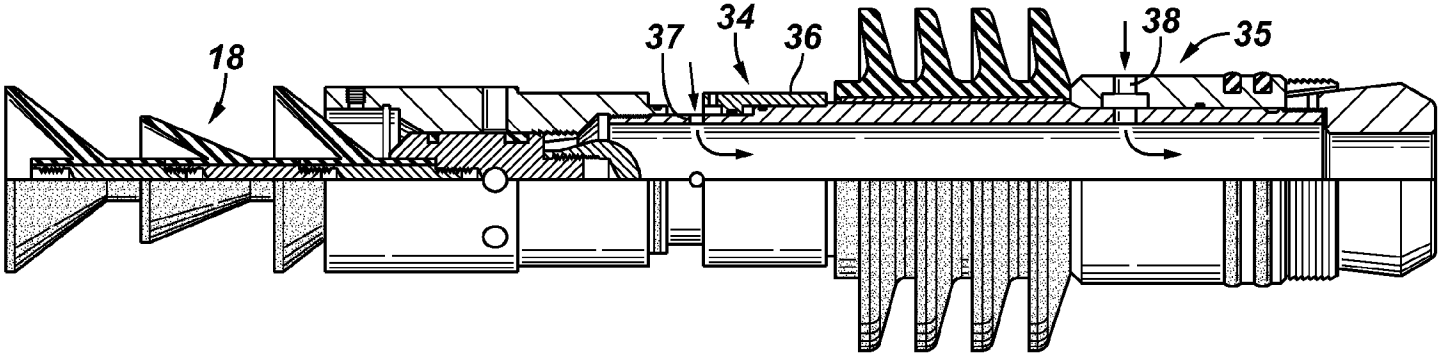

FIG. 3B shows an embodiment of liner wiper plug 16 with two bypass mechanisms 34, 35, either of which could be considered the primary or secondary bypass system. FIG. 3B also shows pump down plug 18 engaged with first end 29 of liner wiper plug 16, which interrupts the flow path 31 and causes the pressure to rise external the liner wiper plug 16 due to the seal formed by the seal elements 32 and the liner 17 (not shown), and the seal formed between the second end 30 and the landing collar 19 (not shown). Bypass mechanism 34 comprises a sliding sleeve 36 which is initially covering a first bypass port 37. When the pressure external the liner wiper plug 16 reaches a predetermined level, sliding sleeve 37 will shift (for example, by utilizing a reverse piston or other shifting mechanism) thereby exposing first bypass port 37. Bypass port 37 allows for fluid communication or flow from outside the liner wiper plug 16 and into flow path 31, such that a displacing fluid pumped from the surface and through the liner hanger system 14 will be communicated through the liner wiper plug 16.

Bypass 35 comprises a second bypass port 38, which allows fluid communication or flow from outside the liner wiper plug 16 and into the flow path 31. However, as bypass 35 and the second bypass port 38 are located behind the sealing elements 32, there is no fluid to flow so long as seal elements 32 are engaged with liner 17 to form a pressure seal between liner wiper plug 16 and liner 17 of liner hanger system 14. Bypass 35 is activated when the pressure pumped from surface through liner hanger system 14 becomes great enough to deform or break the seal elements 32, thereby allowing fluid to flow past the deformed seal elements and into the second bypass port 38. Bypass port then allows for fluid communication or flow from outside the liner wiper plug 16 and into flow path 31, such that a displacing fluid pumped from the surface and through the liner hanger system 14 will be communicated through the liner wiper plug 16.

In embodiments according to the instant disclosure, where liner wiper plug 16 comprises at least one bypass mechanism to allow displacing fluid to be communicated through the liner wiper plug 16 after it is engaged with landing collar 19, it may then be possible to pump displacing fluid into the shoe track area 21 immediately after cementing operations. In these embodiments, the displacing fluids may clear cement from the shoe track area 21, and therefore stop the formation of cement plug 28 in shoe track area 21.

Figure 4:
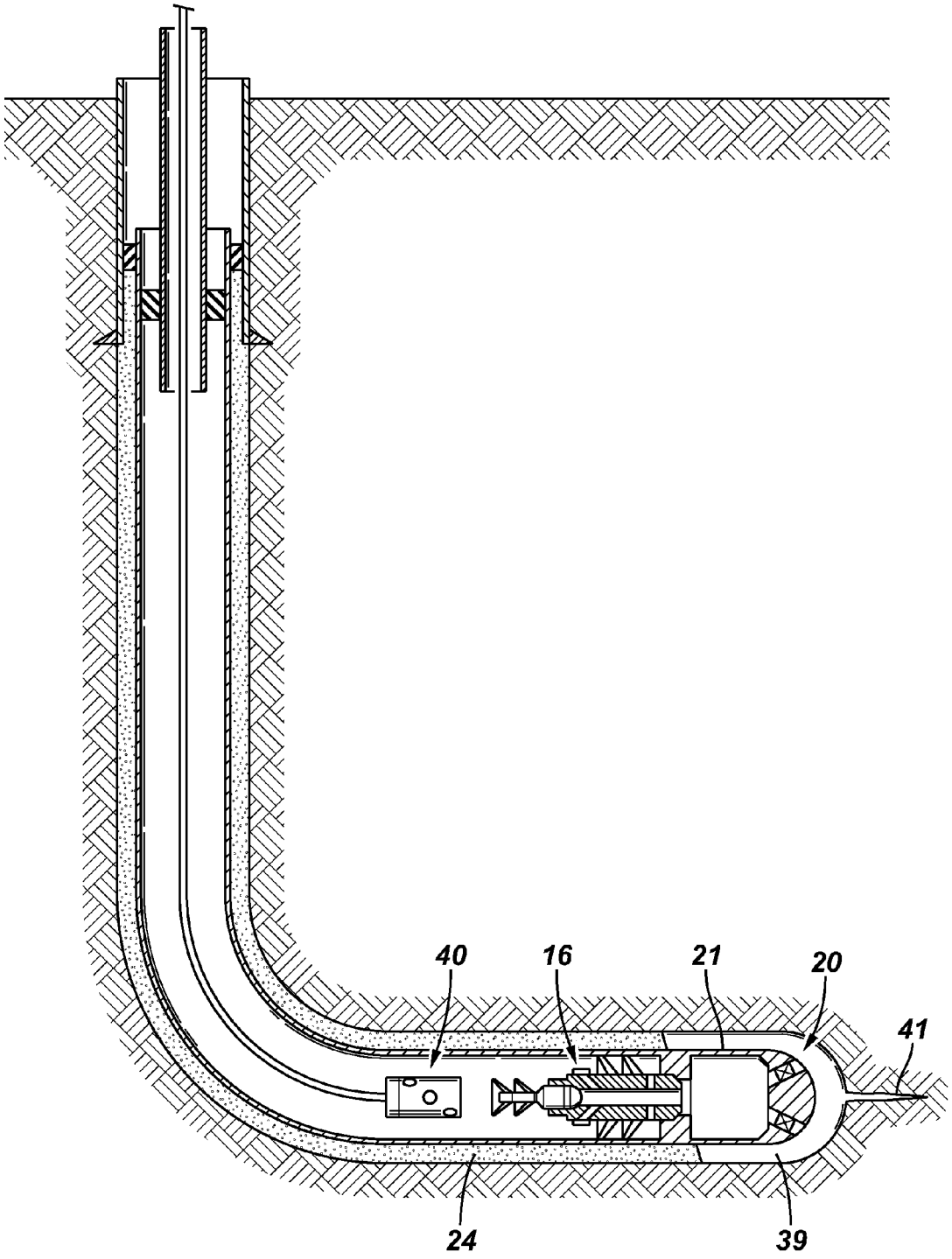
FIG. 4 is another illustration of an embodiment of an well system, according to an embodiment of the disclosure.

FIG. 4 shows an embodiment of liner hanger system 14 comprising a liner wiper plug 16 which comprises a bypass system. Because the bypass system of liner wiper plug 16 allows displacing fluid to pass, the cement 24 does not fill the entire wellbore 11, but instead a non-cemeneted portion 39 is present near the end or toe of the liner hanger system 14. Shoe track area 21 is also clear of cement. These areas may be cleared by pumping displacing fluid after cementing operations. For instance, after the liner wiper plug assembly 25 engages with the landing collar 19, signifying the interior of the liner 17 is substantially free of excess cement, displacing fluids may continue to be pumped to increase the pressure in the liner hanger system 14. When pressure reaches a predetermined point, the bypass system 34 on liner wiper plug 16 may be activated and displacing fluid may then flow through liner wiper plug 16, into the downstream liner hanger system 14 elements (e.g. shoe track area 21, float shoe 20). Displacing fluid may also exit the interior of the liner hanger system 14 through the valves 26, to create the non-cemented portion 39 external the liner hanger system 14. As the interior volume of the liner hanger system 14 is typically known, and as the volume of the open hole 22 is roughly known or may be approximated, in some embodiments a fixed amount of displacing fluid may be pumped through the opened bypass. Pumping a fixed amount of displacing fluid may allow some degree of control over the size of the non-cemented portion 39, so that the non-cemented portion does not become so large as to threaten the integrity or stability of the liner hanger system 14 cement to open hole interface. In other words, the amount of displacing fluid pumped through the bypass may be limited so that the desired amount cement will remain external the liner hanger system 14.

After the shoe track area 21 is cleared and the non-cemented portion 39 is created, the cement may be allowed to cure. Excess displacement fluid may flow or travel into the open hole portions of the wellbore in the non-cemented portion 39. After the cement properly cures, additional well operations may be performed. These additional well operations may now be performed without the need for a drilling operation, for instance, a drilling operation to remove a cement plug from the shoe track area 21.

In some embodiments, perforating guns 40 may be pumped into a a horizontal portion of the wellbore 11 to perform a perforating operation. In these embodiments, the guns may be pumped into the horizontal portion of the wellbore 11, because the pumping fluids which carry the perforating guns 40 have a flow path to travel through cement free shoe track area 21, into the non-cemented area 39. In some embodiments, a hydraulic fracturing operation may be performed to create at least one fracture 41 in the non-cemented portion 39. As with the aforementioned perforating operation, the hydraulic fraction operation may now be performed because a flow path exists through the liner hanger system 14 which is not blocked by a cement plug in the shoe track area 21 or in the area outside the end or toe of the liner hanger system 14.

While a limited number of embodiments been described, those skilled in the art, having the benefit of this disclosure, will appreciate numerous modifications and variations there from. It is intended that the appended claims cover all such modifications and variations.

What is claimed is:

1. A method of cementing a liner hanger system in a wellbore, comprising:

1) providing a liner hanger system in a wellbore, the liner hanger system comprising a float shoe, a setting tool comprising a liner wiper plug, and a landing collar;
2) cementing the liner hanger system into the wellbore by pumping cement through the liner hanger system;
3) dropping a pump down plug into the liner hanger system, and landing the pump down plug in the liner wiper plug;
4) disengaging the landed pump down plug and liner wiper plug assembly from the setting tool, wherein the plug assembly travels through a portion of the liner hanger system and lands on the landing collar forming pressure seal;
5) opening a bypass on the liner wiper plug and pumping displacing fluid through the opened bypass to clear cement located in a shoe track area between the landing collar and the float shoe, wherein opening the bypass assembly comprises
   a) increasing the pressure within the liner hanger assembly;
   b) deforming at least one wiper seal element in response to the increase in pressure; and
   c) passing fluid flow around the deformed wiper seal element and through a bypass port which allows for a flow path from the exterior of the plug assembly into the interior of the plug assembly; and
6) curing the cement around the liner hanger system while leaving the shoe track area at least partly of cement and an area outside of the shoe track area at least partially free of cement, thereby allowing at least some fluid communication from within the liner hanger system to the formation surrounding the wellbore.

2. The method of claim 1, further comprising deploying perforating guns into the wellbore to a desired location for a perforating operation, wherein:

the wellbore is at least partially horizontal;

the desired location for the perforating operation is located in the horizontal section of the wellbore; and deploying the perforating guns comprises pumping the perforating guns into position.

3. The method of claim 2, further comprising deploying perforating guns into the wellbore after the cementing of the liner hanger system into the wellbore and before any additional drilling operation.

4. The method of claim 1, further comprising fracturing the wellbore in the area outside of the shoe track which is at least partly free of cement.

5. The method of claim 4, further comprising fracturing the wellbore after the cementing of the liner hanger system into the wellbore and before any additional drilling or perforating operations.

6. The method of claim 1, wherein opening the bypass on the plug assembly comprises:

1) increasing the pressure within the liner hanger assembly;
2) opening a sleeve portion of the plug assembly in response to the increase in pressure; and
3) exposing a bypass port which allows for a flow path from the exterior of the plug assembly into the interior of the plug assembly.

7. The method of claim 1, further comprising pumping a fixed amount of displacing fluid through the opened bypass, wherein the fixed amount of displacing fluid is calculated to be enough to substantially clear the shoe track area of any remaining cement and to only partially clear cement from the area out the liner hanger near the shoe track area.

8. A liner wiper plug, comprising:

1) first and second ends, the first end suitable to interface with a pump down plug, and the second end suitable to interface with a landing collar;
2) a flow path through the liner wiper plug, the flow path allowing fluid communication from the first end to the second end;
3) a plurality of wiper seal elements, the wiper seal elements suitable to form a pressure seal between the exterior of the liner wiper plug and a liner hanger system in which the liner wiper plug is deployed;
4) a first bypass mechanism which when activated allows fluid communication from outside the liner wiper plug into the flow path through the liner wiper plug; and
5) a secondary bypass mechanism which when activated allows fluid communication from outside the liner wiper plug into the flow path through the liner wiper plug, wherein the secondary bypass mechanism is activated by a pressure external to the liner wiper plug which is greater than the pressure necessary to activate the first bypass mechanism.

9. The liner wiper plug of claim 8, wherein the bypass mechanism comprises a sliding sleeve and a bypass port, wherein:

the bypass port is covered by the sliding sleeve until a pressure increase external the liner wiper plug causes the sliding sleeve to shift and expose the bypass port; and the bypass port allows fluid communication from outside the liner wiper plug into the flow path through the liner wiper plug.

10. The liner wiper plug of claim 8, wherein the bypass mechanism comprises the wiper seal elements and a bypass port, wherein:

the bypass port is located behind the wiper seal elements;

the wiper seal elements block fluid communication to the bypass port until a pressure increase external the liner wiper plug causes the wiper seal elements to deform, thereby creating a fluid flow path around the wiper seal elements to the bypass; and the bypass port allows fluid communication from outside the liner wiper plug into the flow path through the liner wiper plug.

* * * * *